US011570853B2

(12) United States Patent
Egenter et al.

(10) Patent No.: US 11,570,853 B2
(45) Date of Patent: Jan. 31, 2023

(54) METHOD FOR ACTUATING A HEATING DEVICE OF A HOB, AND HOB

(71) Applicant: E.G.O. Elektro-Geraetebau GmbH, Oberderdingen (DE)

(72) Inventors: Christian Egenter, Bretten (DE); Marcus Frank, Sulzfeld (DE); Matthias Mangler, Karlsbad (DE); Jochen Rickert, Oberderdingen (DE)

(73) Assignee: E.G.O. Elektro-Geraetebau GmbH, Oberderdingen (DE)

( * ) Notice: Subject to any disclaimer, the term of this patent is extended or adjusted under 35 U.S.C. 154(b) by 0 days.

(21) Appl. No.: 17/248,624

(22) Filed: Feb. 1, 2021

(65) Prior Publication Data

US 2022/0248504 A1 Aug. 4, 2022

(51) Int. Cl.
*H05B 3/68* (2006.01)
*H05B 3/74* (2006.01)
(Continued)

(52) U.S. Cl.
CPC ..... *H05B 3/746* (2013.01); *F24C 7/087* (2013.01); *H05B 1/0258* (2013.01)

(58) Field of Classification Search
CPC ..... H05B 3/0071; H05B 3/683; H05B 3/74; H05B 3/742; H05B 3/744; H05B 3/746;
(Continued)

(56) References Cited

U.S. PATENT DOCUMENTS 4,829,279 A 5/1989 Kicherer et al.
5,270,519 A * 12/1993 Higgins ..... H05B 3/742 219/448.19
(Continued)

FOREIGN PATENT DOCUMENTS

DE 69015364 T2 5/1995
DE 10129170 A1 12/2002
(Continued)

OTHER PUBLICATIONS

European Patent Office, Extended European Search Report received for Application No. EP 21153208.0, dated Jun. 28, 2021, 6 pages, Germany.
(Continued)

*Primary Examiner* — Hung D Nguyen
(74) *Attorney, Agent, or Firm* — Alston & Bird LLP

(57) ABSTRACT

A hob plate above a radiant heating device and a safety temperature limiter between said radiant heating device and hob plate, which safety temperature limiter is designed to deactivate the radiant heating device when a switch-off temperature is reached. To actuate the radiant heating device, a cooking vessel is first placed on the hob plate above the radiant heating device and then the radiant heating device is activated and at the same time detection of a first switch-on time starts. When a switch-off temperature is reached at the safety temperature limiter, the radiant heating device is deactivated by said safety temperature limiter. The first switch-on time that has elapsed up to that point between activation and deactivation of the radiant heating device is detected and compared with a predefined limit switch-on time. If the first switch-on time lies below the limit switch-on time the radiant heating device is switched off.

26 Claims, 5 Drawing Sheets

(51) Int. Cl.
*H05B 1/02* (2006.01)
*F24C 7/08* (2006.01)

(58) Field of Classification Search
CPC ..... H05B 3/748; H05B 3/76; H05B 1/0216; H05B 1/0258; H05B 1/0266; H05B 1/0269; H05B 1/0294; F24C 7/046; F24C 7/083; F24C 7/087; F24C 7/088; F24C 15/102; F24C 15/105; F24C 15/106
USPC ..... 219/443.1, 444.1, 445.1, 446.1, 447.1, 219/448.11, 448.12, 448.14–448.19, 482, 219/483, 487, 490, 491, 494, 510, 511
See application file for complete search history.

(56) References Cited

U.S. PATENT DOCUMENTS

| | | | | |
|---|---|---|---|---|
| 5,324,917 | A | 6/1994 | Boyer et al. | |
| 5,498,853 | A | 3/1996 | Gross et al. | |
| 5,721,419 | A * | 2/1998 | Wauer | G05D 23/1917 219/492 |
| 5,961,867 | A | 10/1999 | McWilliams | |
| 7,345,572 | B2 | 3/2008 | Losbichler et al. | |
| 2004/0178187 | A1* | 9/2004 | McWilliams | H05B 3/746 219/448.17 |
| 2004/0262296 | A1* | 12/2004 | Wilkins | H05B 3/748 219/622 |
| 2005/0016990 | A1 | 1/2005 | Wilkins et al. | |
| 2006/0196869 | A1* | 9/2006 | McWilliams | H05B 3/74 219/506 |
| 2006/0213901 | A1* | 9/2006 | Wilkins | H05B 3/746 219/492 |
| 2006/0237438 | A1* | 10/2006 | Wilkins | H05B 3/746 219/505 |
| 2008/0217318 | A1* | 9/2008 | Azpiritxaga | F24C 15/105 219/448.11 |
| 2008/0308547 | A1 | 12/2008 | Zhang et al. | |
| 2016/0014846 | A1* | 1/2016 | Grunow | H05B 1/0266 219/483 |

FOREIGN PATENT DOCUMENTS

| | | | |
|---|---|---|---|
| DE | 69832329 | T2 | 7/2006 |
| DE | 602004005105 | T2 | 12/2007 |
| DE | 102008014268 | A1 | 9/2009 |
| DE | 102009060125 | A1 | 6/2011 |
| EP | 1922961 | A1 | 5/2008 |
| EP | 2472999 | A1 | 7/2012 |

OTHER PUBLICATIONS

German Patent and Trade Mark Office, Search Report received for Application No. 102020201610.0, dated Nov. 23, 2020, 4 pages, Germany.

* cited by examiner

METHOD FOR ACTUATING A HEATING DEVICE OF A HOB, AND HOB

CROSS-REFERENCE TO RELATED APPLICATIONS

This application claims priority to German Application No. 10 2020 201 610.0, filed Feb. 10, 2020, the contents of which are hereby incorporated herein in its entirety by reference.

FIELD OF APPLICATION AND PRIOR ART

The invention relates to a method for actuating a heating device of a hob or a cooking device, and to a corresponding hob or cooking device. Here, the hob has a radiant heating device as the heating device, a hob plate above said radiant heating device, and a safety temperature limiter between the two. A safety temperature limiter of this kind is designed as a thermomechanical functional device in order to deactivate the radiant heating device when an excessively high temperature or a switch-off temperature is reached. This serves in particular to protect the hob plate against damage due an excessively high temperature on the basis of the heating power of the radiant heating device. Safety temperature limiters of this kind are known from the prior art, for example from U.S. Pat. No. 7,345,572.

One disadvantage of safety temperature limiters of this kind is that although they function very reliably in the case of an excessively high switch-off temperature that is detected by them, their switching behavior is determined directly by the temperature that is detected by them and to date it has not been possible to change the activation state of the radiant heating device on the basis of processes in a cooking vessel on the hob plate.

Problem and Solution

The invention is based on the problem of providing a method mentioned at the outset and a hob or cooking device mentioned at the outset by way of which problems that arise in the prior art can be solved and in particular it is possible to use a such a hob or its radiant heating device in an advantageous, versatile and practical manner, in particular to ensure safe operation of the hob.

This problem is solved by a method having the features of the claims and by a hob or cooking device having the features of the claims. Advantageous and preferred refinements of the invention are the subject matter of the further claims and will be explained in greater detail below. In said explanation, some of the features will be described only for the method or only for the hob. However, irrespective of this, they are intended to be able to apply independently both to the method and also to the hob. The wording of the claims is incorporated in the description by express reference.

It is provided that the hob is designed as explained at the outset. Here, the safety temperature limiter is advantageously fastened to the radiant heating device or said radiant heating device comprises the safety temperature limiter, so that the two can form a prefabricated structural unit. To this end, the safety temperature limiter is particularly advantageously arranged in an upper region of the radiant heating device, so that it can run, at least by way of an elongate temperature detecting element or a temperature detecting device, between the radiant heating device or its heating conductors and the hob plate. This is the active region of the radiant heating device or its heating conductors upward through the hob plate into a cooking vessel that is placed on it. The hob can have yet further customary switching devices, in particular as a power supply for the radiant heating device. These possibilities will be explained in even greater detail below. The safety temperature limiter is designed to switch off or to deactivate the radiant heating device when a predetermined switch-off temperature is reached.

For the method, it is provided as a preceding step that a cooking vessel is placed on the hob plate above the radiant heating device, in particular where a so-called cooking point is formed by the radiant heating device. This hob is intended to be heated by means of the radiant heating device, for which purpose said radiant heating device is activated. The power supply to the radiant heating device, for example by relays or electromechanical switches, advantageously serves for this activation. When the activation of the radiant heating device starts, a first switch-on time is monitored or starts to run, advantageously in a type of timer of a hob controller. This first switch-on time is the time or period for which the radiant heating device is operated or is activated for the first time after the hob is switched on, in particular at least when the hob plate is cold or has cooled down after previous operation.

The radiant heating device is then activated or supplied with power and heats up the placed-on cooking vessel. At the same time, the safety temperature limiter or at least its abovementioned temperature detection device is also heated up as a result, so that the temperature that is detected by it likewise rises. At some point, the abovementioned switch-off temperature is reached on the safety temperature limiter, this leading to the radiant heating device being deactivated by the safety temperature limiter. In particular, this deactivation can take place by way of a direct switching process. At the same time, the first switch-on time is stopped or its end is established, and it is monitored or recorded. respectively. Therefore, the first switch-on time specifies the period between first activation and deactivation of the radiant heating device.

Finally, the monitored or recorded first switch-on time is compared with a predefined limit switch-on time. If the first switch-on time lies below the limit switch-on time, the power with which the radiant heating device is activated and is operated or is operated during the activation is reduced. A reduction can take place to different extents, as will be explained in even greater detail below.

This can cover the possibility of a placed-on cooking vessel becoming too hot too quickly during heating, so that for example grease or the like that is contained in said cooking vessel could catch fire. The resulting risk of an accident is very high, for which reason it should be avoided as far as possible; grease fires in the kitchen are very dangerous. However, if a placed-on cooking vessel contains a sufficient quantity of product being cooked, which reduces the heat that is generated by the radiant heating device through its mass or for example, because it consists largely of water, absorbs said heat by evaporation, the time taken until the radiant heating device is deactivated, that is to say is switched off, by the safety temperature limiter for the first time is therefore longer than the predefined limit switch-on time. However, the abovementioned possibility should be avoided.

Therefore, in the abovementioned case, heating is performed during the first heating cycle of the radiant heating device or during its first activation with the full, set power but this is no longer done afterward. In particular when the radiant heating device is connected directly to a supply voltage or to a mains voltage and either operates in the connected state with full power or else is deactivated, the radiant heating device is therefore activated with its full or maximum power during this first switch-on time. A reduction of its power can then take place either in a very simple case by way of, for said case of the first switch-on time lying below the limit switch-on time, that is to say the heating having taken place too quickly, the radiant heating device being deactivated for a certain time which lies above the time for the switched-off state that is actually provided for the set operation or cyclical operation, that is to say lasts longer. In this case, the entire hob is advantageously not switched off since it can be assumed that there is no fatal or serious fault but rather only a situation of a possibly excessively high temperature or dangerously high temperature at this cooking vessel, that is to be heated, above the radiant heating device. Such a deactivation of the radiant heating device or reduction of its power can be selected or prespecified for example for a time period of from 1 min to 5 min.

Such very quick heating and therefore premature deactivation of the radiant heating device by the safety temperature limiter usually takes place when a placed-on cooking vessel is empty or has only very little contents, for example only a very small amount of water or oil or grease. A small amount of water could be evaporated very quickly and, due to the further heating of the cooking vessel that then takes place, said cooking vessel could be damaged, for example by way of said cooking vessel deforming or bending to a great extent. When there is a small amount of oil or grease, there is a risk of this reaching temperatures of almost 400° C. or above and it could catch fire starting from these temperatures. This risk of fire is intended to be precluded as far as possible by the invention.

In a further advantageous refinement of the invention, a reduction of the power of the radiant heating device is optically and/or acoustically indicated to an operator in said situation. Therefore, an operator can be informed of the possibly associated danger and of the cause of the reduction of power.

Furthermore, it can be provided that an operator can reactivate the operation of the radiant heating device as intended by operating an operator control element. However, this necessarily deliberate action firstly shows that the operator is present and therefore can quickly identify a dangerous situation and can accordingly respond to it. Secondly, such very quick heating may possibly be specifically desired, and if the operator is aware of this, a possible risk of an uncontrollable situation is also reduced or precluded.

As explained above, the safety temperature limiter is advantageously arranged on the radiant heating device. Said safety temperature limiter particularly advantageously has a temperature detection device which can be designed as a thermomechanical temperature detection device. Said temperature detection device can consist of two materials with different coefficients of thermal expansion, this leading to a relative movement in the event of heating. This temperature detection device acts on a switch for deactivating the radiant heating device by switching the switch, preferably on the basis of said relative movement. In particular, this switch can be looped directly into a power supply for the radiant heating device. For this purpose, the safety temperature limiter is advantageously arranged in the vicinity of electrical connections to the radiant heating device, so that connection is simplified. An example of such a radiant heating device is known from U.S. Pat. No. 5,498,853, to which reference is explicitly made hereby. Said document also discloses an arrangement of a safety temperature limiter in the form of a so-called rod-type thermostat. Reference is also explicitly made to abovementioned document U.S. Pat. No. 7,345,572 in respect of such a safety temperature limiter, said document showing the exact design of said safety temperature limiter both with an elongate thermomechanical temperature detection device and with two switches.

In a refinement of the invention, it can be provided that, in the case of an excessively short first switch-on time until the deactivation of the radiant heating device by the safety temperature limiter, the power of the radiant heating device is reduced or said radiant heating device is completely deactivated only when said radiant heating device is intended to be activated with a power which lies above a predefined limit power. Such a limit power can be a power per unit area of more than 5 W/cm$^2$, in particular more than 7 W/cm$^2$, alternatively more than 70% of a maximum power per unit area. In a conventional hob, these would be, for example, powers per unit area starting from a power level of 7. Therefore, the method can be restricted to checking of situations in which the danger mentioned at the outset actually exists on account of a relatively high or very high power of the radiant heating device. On the other hand, it should be stated that, at lower powers or powers per unit area, the first switch-on time will presumably be considerably longer than the predefined limit switch-on time in any case. The method according to the invention would be started, but the limit switch-on time would not be undershot. Therefore, the method would not intervene as a safety function because said situation does not occur. A required or maximum power per unit area also depends on a calibration of the safety temperature limiter. This should mean that the higher the calibration, advantageously the higher the power per unit area is too, otherwise the safety temperature limiter cannot switch quickly enough to identify and to prevent a fault. This can preferably also apply conversely; the higher the power per unit area is intended to be, the higher the calibration should advantageously also be.

In a further refinement of the invention, it is possible for the predefined limit switch-on time to be settable. Therefore, it can be fixedly prespecified not only at the factory, but rather possibly can be changed by an operator. For this purpose, it can be provided that said limit switch-on time is settable only in a separate setting mode on the hob. For the safety function itself, it should be provided that said safety function is always activated, that is to say cannot be deactivated, at least starting from abovementioned relatively high powers for the radiant heating device. The desired safety function is ensured in this way.

In yet a further refinement of the invention, it can be provided that, after a specific cool-down time, which can advantageously be predefined, after reduction of the power at the radiant heating device or the deactivation of said radiant heating device, the previously set power is at least partially re-established, in particular is fully established again. Such a cool-down time can be between 2 min and 5 min. This ensures that the cooking vessel is again heated at least to a specific temperature which at the same time can be considered non-critical. That is to say it does not completely cool down again. However, similarly to the manner explained at the outset, it should be ensured here that the safety function is reactivated. That is to say when the radiant heating device is reactivated after the cool-down time has elapsed, the first switch-on time should in turn begin to run again, and if it once again lies below the limit switch-on time, the safety temperature limiter should therefore once again deactivate the radiant heating device relatively quickly and the power with which the radiant heating device is activated should be reduced or switched off again. Therefore, renewed danger can be precluded.

In a further refinement of the invention, it is possible for the switching behavior of the safety temperature limiter to be monitored, in particular by a hob controller, throughout operation of the radiant heating device. If a time of less than 90 sec, in particular less than 60 sec, elapses between two responses of the safety temperature limiter one after the other or in succession, it can be concluded that the cooking vessel that is heated by the radiant heating device has boiled-dry. A similar safety function is then also achieved during continuous heating of the cooking vessel, that is to say not only at the start. If it is concluded that the cooking vessel has boiled-dry in this way or that the cooking vessel is being heated too quickly, the power for this radiant heating device is once again reduced as explained at the outset, in particular said radiant heating device is deactivated. Such a deactivation or a reduction of the power should take place at least for the abovementioned cool-down time.

Furthermore, it is possible for a ratio of an active time of operation of the radiant heating device to the sum of this active time and a non-active time, during which the radiant heating device is not operated, to be stored in a control device or the hob controller. This can also take place in conjunction with a power level that is set for the radiant heating device. In this case, the control device or hob controller can also monitor and store the power that is generated by the radiant heating device over time, so that this is known. In a further embodiment, it can be provided that the abovementioned ratio of an active time to the sum of the active time and the non-active time for an energy controller, with which the radiant heating device is supplied with power, is greater than the corresponding ratio for the safety temperature limiter. This ensures that, at least for the relatively high or maximum powers for the radiant heating device to be considered here, the safety temperature limiter is switched or switched off for the first time before the energy controller. This may be of importance for detecting the switching process at the safety temperature limiter. Such an energy controller is known, for example, from U.S. Pat. No. 4,829,279 to which reference is explicitly made in this respect.

In one possibility of the invention, it is provided that detection of a switching state of the safety temperature limiter, which is connected in series with an abovementioned energy controller for supplying power for the radiant heating device, takes place only at this energy controller. Since such an energy controller is usually arranged remote from the radiant heating device and close to further control devices or the other energy controllers, an electrical connection is more readily possible here. On the basis of the current flow through the energy controller, a conclusion can then be drawn about the switching state at the safety temperature limiter since, in the event of current flow, the safety temperature limiter has to be switched on and therefore the radiant heating device has to be activated.

According to an alternative second possibility, only detection of the switching state of the energy controller can take place and the switching state at the safety temperature limiter can additionally also be detected at the energy controller. The current flow then does not have to be directly monitored. This is possible by detecting a voltage across the radiant heating device since current flows through the radiant heating device or a voltage is dropped across said radiant heating device only when the safety temperature limiter is closed.

In a further refinement of the invention, it is possible to detect that the cooking vessel has boiled-dry in the further course of the cooking process, that is to say after a few minutes, by way of the time at which the safety temperature limiter respectively activates and deactivates the radiant heating device being detected throughout a cooking process. If it is established after a time of more than 5 min and/or after more than ten deactivations of the radiant heating device by the safety temperature limiter that the duration of the activation of the radiant heating device has shortened, in particular has shortened by at least 10% to 50%, this means that the usual switching pattern or cycle pattern of the safety temperature limiter has changed. If there is no change in the power setting for the radiant heating device, shortening of the duration of the activation can only mean that the cooking vessel has now become considerably hotter than before or can no longer absorb as much heat. This is very often the case in the event of the cooking vessel boiling-dry as mentioned above. If such boiling-dry of the cooking vessel is identified or evaluated as being identified, the power with which the radiant heating device is activated and is operated is reduced or said radiant heating device is deactivated as described above in the case of excessively quick heating at the start being identified.

In an advantageous refinement of the invention, an electronic control device of the hob can have switching elements, preferably relays or power semiconductors, with which the radiant heating device is activated or is deactivated, as the hob controller. Such an activation or deactivation of the radiant heating device advantageously takes place by connection to a mains voltage, in particular directly to the mains voltage, or complete disconnection from the mains voltage. There is no intermediate conversion of a supply voltage for the radiant heating device, as is known for induction heating devices for example. Here, relays are understood to mean other switching devices as comprised by an abovementioned energy controller. Such an energy controller is in fact a thermally actuated electromechanical switching device which, however, does not require or contain any so-called intelligence. Here, a specific duty ratio for the radiant heating device is set at the energy controller and therefore its permanently generated power is set. The hob then has an additional controller in order to detect the switching state of the safety temperature limiter, to monitor the first switch-on time and to carry out the method. Only one single additional controller for all cooking points or all radiant heating devices and electromechanical control devices of the hob is advantageously provided in this case. This additional controller then has corresponding detection means for time and, for example, a microcontroller.

In an abovementioned electronic control device, this prespecifies switching or cycling for relays or other switching means for the radiant heating device after power setting by an operator. The abovementioned possibilities for influencing by means of a controller are met by this electronic control device. An additional controller is not required.

In a further embodiment, it is possible for a switching state of the safety temperature limiter to be detected by at least one of the possibilities mentioned below. According to a first possibility, a voltage across the radiant heating device can be measured. A corresponding voltage measurement can be contained, for example, in an abovementioned electronic control device or an additional controller.

According to a second possibility, a current which flows through the radiant heating device can be measured. A corresponding current measuring device can likewise be contained in the abovementioned electronic control device or additional controller.

According to a third possibility, a current which flows parallel to a series circuit comprising the safety temperature limiter and the radiant heating device can be measured, advantageously upstream of an energy controller or switching means in the direction of the mains connection. This possibility is also advantageously directly integrated into an electronic control device or additional controller.

A mains power supply, which has a connection to a so-called neutral conductor of a power supply system, can advantageously be provided for the hob. Either a single common disconnector relay can be provided in this connection to the neutral conductor for all radiant heating devices or, alternatively, a dedicated disconnector relay can be provided in the connection to the neutral conductor for each radiant heating device. Therefore, for example as a safety function, either an individual radiant heating device or the entire hob can be switched off by means of the disconnector relay.

These and further features are apparent not only from the claims but also from the description and the drawings, where the individual features can in each case be realized on their own or jointly in the form of subcombinations in an embodiment of the invention and in other fields and can constitute advantageous and inherently protectable embodiments for which protection is claimed here. The subdivision of the application into individual sections and sub-headings does not restrict the general validity of the statements made thereunder.

BRIEF DESCRIPTION OF THE DRAWINGS

Exemplary embodiments of the invention are schematically illustrated in the drawings and will be explained in greater detail below.

DETAILED DESCRIPTION OF THE EXEMPLARY EMBODIMENTS

Figure 1:
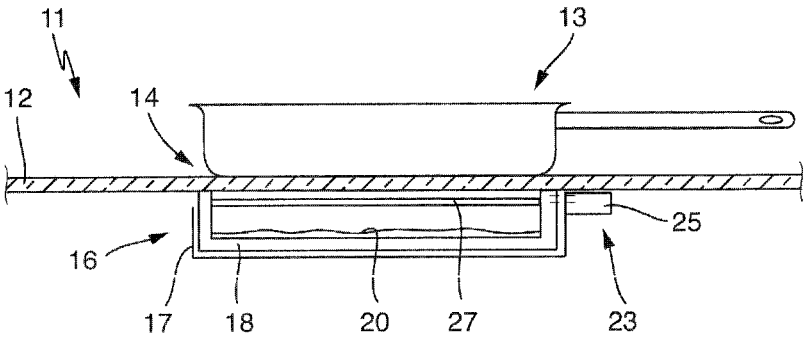
FIG. 1 shows a sectional illustration through a hob according to the invention comprising a radiant heating device and a placed-on item of cookware.

FIG. 1 illustrates a section through a hob 11 according to the invention comprising a hob plate 12. A cooking point 14 on which an item of cookware 13, here a pan, is placed is formed on said hob plate. The cooking point 14 is substantially defined by a radiant heating device 16 of customary design, for example corresponding to abovementioned document U.S. Pat. No. 5,498,853, that is arranged beneath the hob plate. The radiant heating device 16 has a metal receiving tray 17 within which a type of thick thermal insulation 18 which is electrically insulating is arranged. A heating conductor 20 which glows in the visible range during operation with mains voltage and in this way generates radiant heat is laid on the top side of said thermal insulation. Said radiant heat passes upward through the hob plate into the base of the item of cookware 13.

Figure 2:
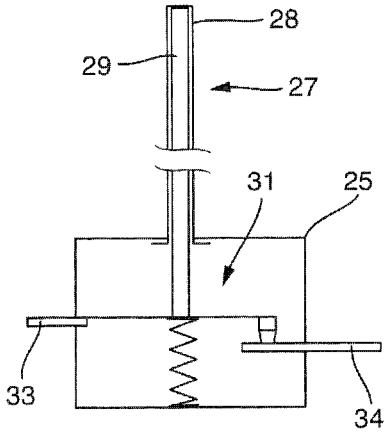
FIG. 2 shows a simplified illustration of a rod-type thermostat as the safety temperature limiter.

A rod-type thermostat 23 is arranged on the radiant heating device 16 as the safety temperature limiter according to the invention. The rod-type thermostat 23 is illustrated on an enlarged scale in FIG. 2 and has a housing 25 from which an elongate sensor 27 extends, specifically over the entire surface area of the heating conductor 20 or between said heating conductor or the radiant heating device 16 and the hob plate 12 according to FIG. 1. Therefore, the rod-type thermostat 23, by way of the elongate sensor 27 as the abovementioned temperature detection element, detects the temperature close to the bottom side of the hob plate 12 which usually consists of glass-ceramic. As is also explained in abovementioned document U.S. Pat. No. 7,345,572, this rod-type thermostat 23 therefore protects the hob plate 12 against excessive heating or excessive temperatures since it could otherwise be mechanically damaged. On account of the properties of the glass-ceramic material which is often used for this purpose, an excessive rise in the electrical conductivity could also otherwise take place, this not being permitted by the safety regulations.

A sensor tube 28 composed of metal, in particular composed of steel, is provided in the elongate sensor 27. An elongate rod 29 composed of ceramic material which, by way of its one free end stops on the inside against the end of the sensor tube 28, runs in the sensor tube 28. When heated, the metal sensor tube 28 expands and therefore becomes longer, while the rod 29 consists of ceramic which does not expand. As a result, the rod 29, in a manner pushed away by a helical spring in the housing 25, moves to a certain extent by way of its other end. This other end bears against a switch 31 which is designed as a simple switching spring here but in practice is advantageously designed as a so-called snap-action spring, also see the abovementioned prior art in this respect. Starting from a specific movement path, the rod 29 no longer presses so strongly against the switch 31 that the two switching contacts still bear against one another, but rather they open. There is then no longer any current flow between the switch connection 33 on the left and the mating connection 34 on the right with which said current flow is switched to the current flow to the radiant heating device 16. The rod-type thermostat 23 is therefore opened and therefore interrupts the current flow to the radiant heating device 16, as a result of which said radiant heating device is deactivated as described at the outset. The temperature at which the switch 31 is opened can be precisely adjusted in the case of such a rod-type thermostat 23 and therefore, for example, can also be set according to the invention such that, in the case of the hob 11, the hob plate 12 does not become too hot on account of the abovementioned aspects.

Figure 3:
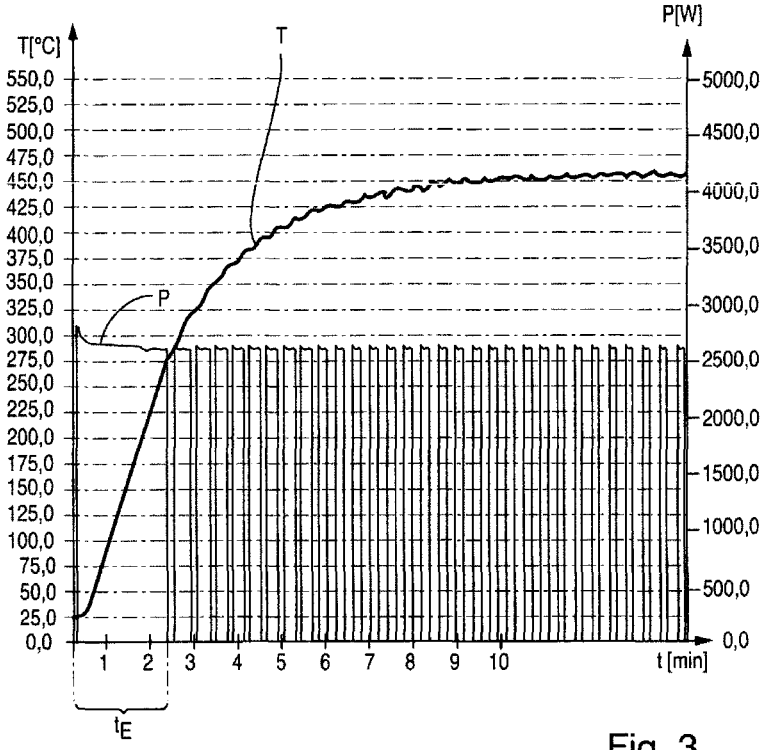
FIG. 3 shows an illustration of a normal time profile for power and temperature with cyclical operation of a radiant heating device of the hob from FIG. 1.

FIG. 3 illustrates the time profile for the average temperature T at the item of cookware 13, specifically at its base, and the power of the radiant heating device 16 in the event of heating or a cooking process according to the prior art. At time t=0, the radiant heating device 16 is switched on or activated, specifically with full mains voltage, that is to say 230 V. Its power P rises very quickly and remains virtually constant, here at approximately 2700 W, for a certain time. In this time, the temperature T rises considerably to approximately 275° C. If the rod-type thermostat 23 is adjusted to a temperature of for example 500° C. to 600° C. for switching, it switches off and respectively deactivates the radiant heating device 16 after a time t=2.2 min as the first switch-on time $t_E$. The rod-type thermostat has therefore reached its switch-off temperature by the operation of the radiant heating device 16 for a period of $t_E$=2.2 min. After a short time, for example 0.2 min, the temperature at the rod-type thermostat 23 has dropped to such an extent that it closes again and therefore reactivates the radiant heating device 16, that is to say it heats again with the previously used power P. As a result, the temperature T at the item of cookware 13 rises again. The next switch-off by the rod-type thermostat 23, because it has reached its switch-off temperature again, takes place significantly more quickly, for example as early as after approximately 0.5 min. Starting from then, a type of cycling with once again respectively slightly shortened durations until a virtually constant temperature of approximately T=460° C. is reached takes place starting from t=10 min with a then regular cycling pattern.

A power supply for the radiant heating device 16 is set here such that it is intended to operate with maximum power and therefore the power supply itself does not switch off the radiant heating device 16 at all. The deactivation of the radiant heating device or the cycling takes place solely with the rod-type thermostat 23. It can be seen here that the temperature T permanently at approximately 460° C. would be so high that, as explained at the outset, either the item of cookware 13 will be damaged by warping or else a small amount of oil or grease could catch fire. A possible situation can be that of an operator having placed the item of cookware 13 containing some fat onto the cooking point 14, set the radiant heating device 16 at maximum power and started operation. The operator may then have possibly left the room. On the basis of FIG. 3, it can be seen that, starting from time t=5 min, the temperature T lies above 400° C. and there is therefore a risk that the grease could catch fire. Although said grease begins to smoke before catching fire, if the operator is not present, they would not notice this and the high potential of danger mentioned at the outset would therefore arise.

Figure 4:
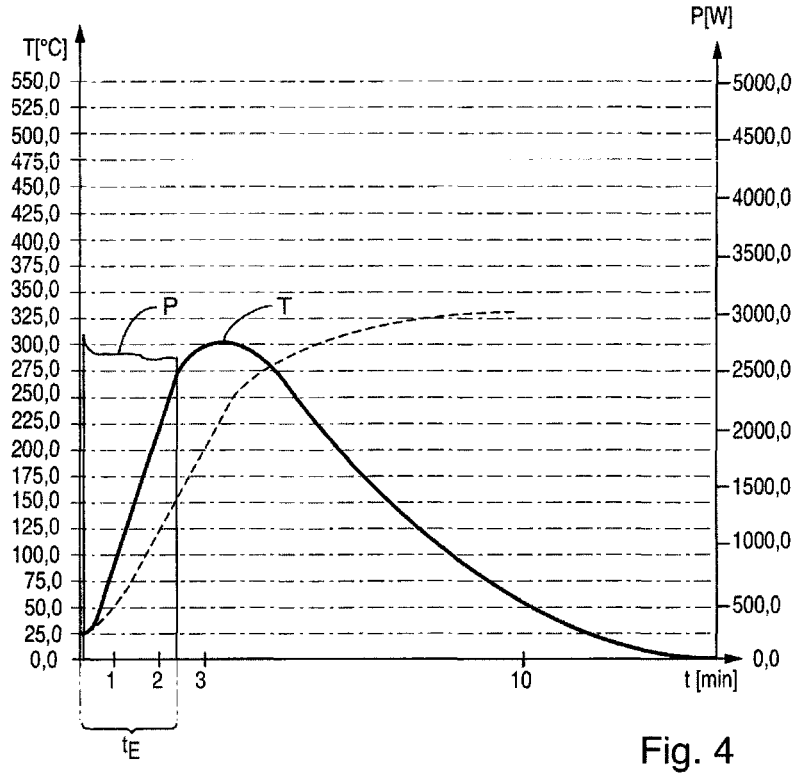
FIG. 4 shows the time profile corresponding to FIG. 3 with incorporation of the invention by deactivating the radiant heating device because the first switch-off by the rod-type thermostat has taken place prematurely.

It is obviously not possible to use the rod-type thermostat 23 to detect the temperature at the item of cookware 13 or at its base itself. However, it can be seen from the temperature profile according to FIG. 3 that the very sharp increase can in fact be attributed to the measured item of cookware 13 alone not having a very large thermal capacity or becoming hot very quickly, otherwise the rise in the temperature T would be flatter and would not end so quickly at correspondingly high temperatures or would not reach said temperatures in the first place. The profile for the temperature would hardly be any different in the case of a small amount of grease. Therefore, the invention in fact proceeds in the way that is illustrated in FIG. 4. Here, a limit switch-on time of 2.3 min is predefined for the first switch-on time $t_E$. If the operation of the hob 11 with the radiant heating device 16 now proceeds as in FIG. 3, its operation starts at time t=0 with the full power, once again a power of P=2700 W here. The temperature T at the rod-type thermostat 23 rises quickly and reaches the set switch-off temperature at time $t_E$ as the first switch-on time of 2.2 min. The rod-type thermostat 23 switches here and respectively deactivates the radiant heating device 16 for the first time. This first switch-off or deactivation is monitored or recorded at time $t_E$ as the first switch-on time which is a time period. Since this lies below the limit switch-on time of 2.3 min, it can be seen that the item of cookware 13 heats up too quickly. It can be concluded from this that said item of cookware is empty or contains only a very small quantity of product being cooked, possibly potentially dangerous product being cooked, such as some grease or oil with the above-described risk of catching fire at excessively high temperatures. Therefore, the power of the radiant heating device 16 is reduced, specifically completely switched off here. As a result, the temperature T further rises slightly to a value of somewhat above 300° C., which is not critical, and then drops again. At the same time, the abovementioned signaling to an operator should be provided, said signaling being able to be optical and/or acoustic and calling attention to this switch-off. As an alternative to the switch-off illustrated here, the power of the radiant heating device could also be reduced, for example halved, as a result of which the abovementioned critical temperatures are likewise no longer reached. However, it is safer in all cases to deactivate the radiant heating device, it being possible for this to be reversed again by an operator by corresponding operator control or operation of an operator control element. However, the operator is then necessarily present and can identify and remedy a dangerous situation.

With reference to FIG. 4, it is readily possible to see how a temperature at the item of cookware 13 of approximately 280° C. would be reached only after considerably over 3 min in the event of a slower rise in the temperature T which is illustrated using a dashed line. This can be the case with a relatively large quantity of product being cooked in the item of cookware 13. It can be concluded from this that the switch-off temperature is reached only later than explained above, for example only after considerably more than 2.5 min corresponding to the limit switch-off time, at the rod-type thermostat 23 as well. Therefore, the safety function would not intervene here, but at the same time it can be assumed that, in the case of the temperature profile that is illustrated using a dashed line, as is indicated, a temperature of at most 330° C. is reached in the long run. No danger can arise here, and therefore the safety function according to the invention is not required. Furthermore, the situation can arise that, in general when water is boiling for example, the power is usually also reset by the user in practice and therefore the apparatus or the hob is inoperative. This means normal cooking processes when the user is present are advantageously not disrupted.

Figure 5:
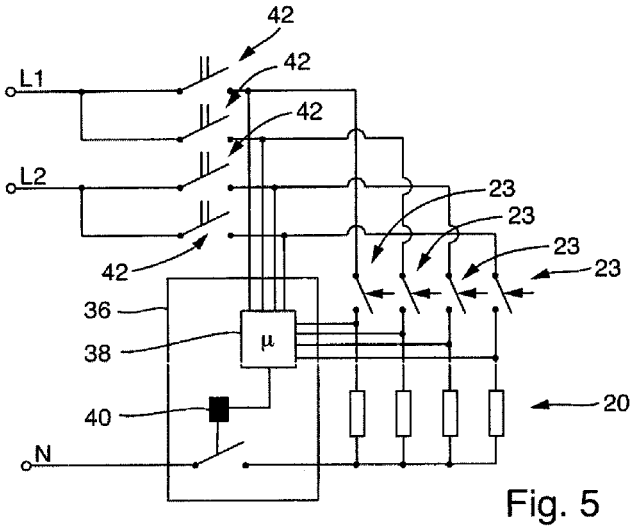
FIG. 5 shows a possible interconnection of four radiant heating devices of a hob, their power being set by energy controllers, with an additional controller for implementing the invention.

FIG. 5 illustrates a simplified interconnection for a hob 11 in order to operate four radiant heating devices or their shown heating conductors 20. The interconnection is connected to two phases L1 and L2 and a neutral conductor of a power supply system. In each case two current paths to the heating conductors 20 are provided for the conductors L1 and L2, where an abovementioned energy controller 42, which determines the level of the permanent power of the heating conductor 20, is first connected in each current path. Furthermore, rod-type thermostats 23 are respectively provided for each heating conductor 20.

An additional controller 36 is provided since no switches, normally even no controller or controller intelligence at all, apart from the energy controllers 42, are provided or have to be provided in such a hob. The additional controller 36 has a microcontroller 38 and a disconnector relay 40 of the heating conductors 20 to the neutral conductor N. The energy controllers 42 and the rod-type thermostats 23 operate as it were autonomously, the energy controllers 42 in the same way as when they are set by an operator. This will be explained in greater detail below. The rod-type thermostats 23 operate, as explained above, at the switch-off temperatures calibrated for them at the factory, specifically likewise autonomously.

The microcontroller 38 is connected to the current paths in front of and behind the rod-type thermostats 23, but a connection can also be designed in another way. As a result, as will be explained further below, the switching state or the current flowing is detected. Therefore, the microcontroller 38 knows when the rod-type thermostat 23 switches off or deactivates the radiant heating device 16 or the heating conductor 20, and it can therefore detect the first switch-off time in the manner described at the outset. Therefore, said rod-type thermostat detects the period starting from the first switch-on or activation of the radiant heating device 16 with the heating conductors 20 until its first switch-off or deactivation. This monitored first switch-on time is then compared with a limit switch-on time that is stored in the microcontroller 38, as has been explained above. If said monitored first switch-on time lies below said limit switch-on time, the power of the radiant heating device which has as it were heated up too quickly has to be reduced. Since the additional controller 36 or the microcontroller 38 cannot directly actuate the energy controller 42 for the corresponding radiant heating device, likewise cannot actuate the rod-type thermostat 23, and otherwise only a single disconnector relay 41 is jointly provided in the current path to each radiant heating device 16, the additional controller 36 can open only the disconnector relay 40. Therefore, not only the radiant heating device 16 in question, but rather all radiant heating devices 16, are switched off. However, this is not possible in a different way here, and the safety function is therefore ensured in all cases. As an alternative, a disconnector relay to the neutral conductor could also be provided separately for each of the radiant heating devices 16 or their heating conductors 20. However, the complexity would then be considerably higher. The disconnector relay 40 does not necessarily have to be installed in the additional controller 36 either; it may be a disconnector relay that is possibly present in any case with an additional connection to the additional controller 36.

Precise possibilities for detecting the activation state of the rod-type thermostat 23 are not illustrated in FIG. 5 here, but these are readily conceivable since they have already been described above. Furthermore, possibilities which can also be used here in a corresponding manner are described in FIGS. 7 to 9.

Figure 6:
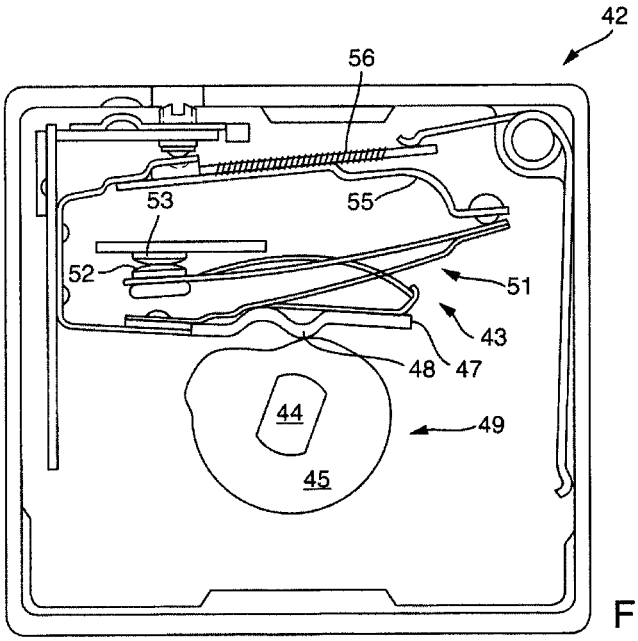
FIG. 6 shows an illustration of the internal design of an energy controller.

FIG. 6 illustrates, in detail, an energy controller 42 according to U.S. Pat. No. 4,829,279, to which reference is explicitly made in this respect. The energy controller 42 has a device switch 43 which is designed as a so-called snap-action switch. A non-round cam disk 45 is seated on a rotary shaft 44 which can be turned by an operator by means of an operator control knob. A projection 48 of a carrying lever 47 bears against the outer edge of said cam disk in a spring-loaded manner, as a result of which an adjusting device 49 for the device switch 43 is formed. The device switch 43 is fastened to the carrying lever 47. It has a snap-action spring 51 with a switching contact 52 at the left-hand end. The switching contact 52 bears against a mating contact 53, that is to say the energy controller 42 conducts current since the device switch 43 is closed. A switching member 55 composed of a bimetal which presses onto the right-hand free end of the snap-action spring 51 is provided. The heating element 56 which is heated when the device switch 43 is closed is provided above said free end. As a result, the switching member 55 bends in the clockwise direction, that is to say with the right-hand free end downward, and therefore presses onto the right-hand free end of the switching spring 51. Starting from a specific path, the snap-action spring 51 snaps and opens the device switch 43, that is to say the current flow is interrupted. In the process, the heating element 56 is also no longer heated and cools down again just like the switching element 55 which bends back again, and therefore renders possible renewed closing of the device switch 43. Therefore, cycling is achieved. The respective periods can be set by turning the cam disk 45 by means of the rotary shaft 44. This is an electromechanical or electro-thermomechanical power setting for a radiant heating device 16.

Figure 7:
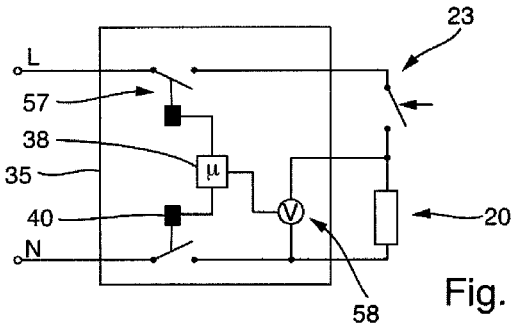
FIGS. 7 to 9 show various simplified interconnections as possibilities for identifying a deactivation of the radiant heating device by the rod-type thermostat.

FIG. 7 illustrates in a simplified way how a microcontroller 38 is provided on its own, without energy controllers or the like, in an electronic hob controller for the hob 11, that is to say the corresponding hob has its own intelligence. The microcontroller 38 is supplied with information by operator control elements, for example customary touch-operated switches, for example a power setting by an operator, this having taken place via the energy controller 42 in the abovementioned example. The hob controller 35 comprising the microcontroller 38 has a relay 57 in order to likewise operate the heating conductor 20 of the radiant heating device 16 in a cyclical manner, similarly to the manner illustrated in FIGS. 3 and 4 and in the way the energy controller 42 also does it. To this end, the relay 57 is connected to the microcontroller 38 and thereby replaces an energy controller. Furthermore, a disconnector relay 40 to the neutral conductor N, for example a single disconnector relay for all radiant heating devices 16, is provided for safety purposes.

Voltage measurement by means of a voltage measuring device 58 is provided here for detecting the switching state of the rod-type thermostat 23. Said voltage measuring device is connected parallel to the heating conductor 20. If the relay 57 is closed and a voltage is detected at the voltage measuring device 58, the rod-type thermostat 23 also has to be closed. If the relay 57 is closed, but the voltage measuring device 58 does not establish a voltage at the heating conductor 20, the rod-type thermostat 23 has opened or deactivated the heating conductor 20. Therefore, the first switch-on time can be monitored or recorded and then, as explained above in relation to FIG. 5, the microcontroller 38 can carry out the comparison with a stored prespecified limit switch-on time. The other measures correspond to those as explained above.

Figure 8:
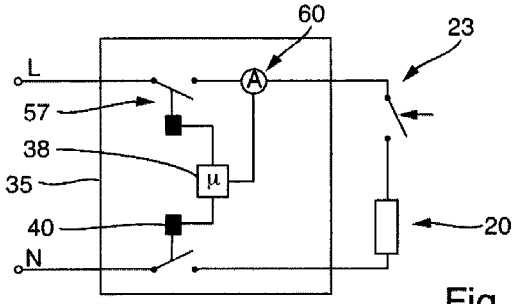

FIG. 8 illustrates an alternative refinement of the hob controller 35 comprising a current measuring device 60 which is looped into the current path to the heating conductor 20 downstream of the relay 57 and therefore still within the hob controller 35. The current measuring device 60 can establish a current flow only when both the relay 57 is closed by the microcontroller 38 and the rod-type thermostat 23 is closed. When the relay 57 is closed, an interruption in the current flow necessarily means that, when the disconnector relay 40 is likewise closed, the rod-type thermostat 23 has opened. The first deactivation of the heating conductor 20 or of the radiant heating device 16 after the first switch-on time by the rod-type thermostat 23 can also be monitored or recorded in this way.

Figure 9:
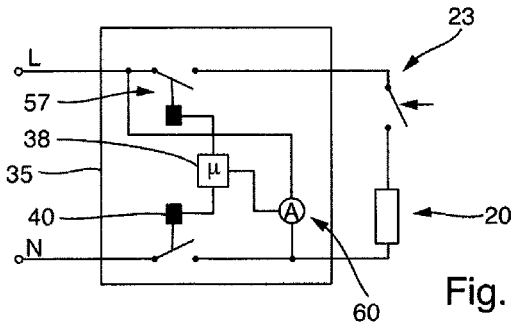

In the yet further exemplary embodiment of FIG. 9, a current measuring device 60 is provided from the connection of the relay 57 to the phase L to the connection of the heating conductor 20 to the disconnector relay 40. If the relay 57 and the disconnector relay 40 are closed, it is therefore possible to likewise identify, by monitoring the current flow, whether the rod-type thermostat 23 is closed or open. The microcontroller 38 can also monitor or record the first switch-on time or its duration in this way.

The optical or acoustic signaling to an operator mentioned at the outset when the power for the radiant heating device 16 has been reduced or has been deactivated, that is to say has been switched off, is not illustrated here. However, such signaling can be easily generated by the microcontroller 38 in each case; this does not present any problems in respect of implementation.

The invention claimed is:

1. A method for actuating a heating device of a hob, wherein said hob has:

at least one radiant heating device as said heating device, a hob plate, wherein said radiant heating device is arranged beneath said hob plate, a safety temperature limiter being designed as a thermomechanical functional device and being arranged between said radiant heating device and said hob plate, wherein said safety temperature limiter is designed to deactivate said radiant heating device when a switch-off temperature is reached, comprising the steps of:

placing a cooking vessel on said hob plate above said radiant heating device, activating said radiant heating device and at the same time starting recording of a first switch-on time, detecting a deactivation of said radiant heating device by said safety temperature limiter when a switch-off temperature is reached at said safety temperature limiter and monitoring said first switch-on time having elapsed up to a point of time between said activating and said deactivation of said radiant heating device, comparing said monitored first switch-on time with a predefined limit switch-on time, where, if said first switch-on time lies below said limit switch-on time, a power is reduced, wherein said radiant heating device is activated and is operated with said power.

2. The method as claimed in claim 1, wherein, if said first switch-on time lies below said limit switch-on time, said radiant heating device is deactivated.

3. The method as claimed in claim 2, wherein said entire hob is not switched off when said radiant heating device is deactivated.

4. The method as claimed in claim 1, wherein said reducing of said power of said radiant heating device, because said first switch-on time lies below said limit switch-on time, is optically or acoustically indicated to an operator.

5. The method as claimed in claim 1, wherein said safety temperature limiter is arranged on said radiant heating device, where said safety temperature limiter has a temperature detection device acting on a switch of said hob or of said safety temperature limiter for deactivating said radiant heating device for switching purposes.

6. The method as claimed in claim 1, wherein said safety temperature limiter is designed as a rod-type thermostat.

7. The method as claimed in claim 1, wherein said radiant heating device is deactivated or its power is reduced only when a power with which said radiant heating device is intended to be activated lies above a predefined limit power.

8. The method as claimed in claim 7, wherein said predefined limit power is at a power per unit area of more than 5 $W/cm^2$.

9. The method as claimed in claim 1, wherein said predefined limit switch-on time is settable by an operator in a separate setting mode.

10. The method as claimed in claim 1, wherein, after a specific cool-down time after said reducing of said power at said radiant heating device or said deactivating of said radiant heating device, said previously set power is at least partially re-established.

11. The method as claimed in claim 10, wherein said specific cool-down time is predefined.

12. The method as claimed in claim 10, wherein a ratio of an active time to a sum of said active time and a non-active time for said radiant heating device is stored in a control device of said hob.

13. The method as claimed in claim 12, wherein said control device also monitors and stores said power being generated by said radiant heating device over time.

14. The method as claimed in in claim 10, wherein said ratio of an active time to a sum of said active time and a non-active time of an energy controller for supplying power to said radiant heating device is greater than a ratio of an active time to a sum of said active time and a non-active time for said safety temperature limiter.

15. The method as claimed in claim 1, wherein a switching behavior of said safety temperature limiter is monitored throughout an operation of said radiant heating device, where, if a time of less than 90 sec elapses between two responses of said safety temperature limiter one after the other, it is concluded that said cooking vessel being heated by said radiant heating device has boiled-dry and then said power for said radiant heating device is reduced.

16. The method as claimed in claim 15, wherein said radiant heating device is deactivated.

17. The method as claimed in claim 1, wherein detection of a switching state and of a current flow takes place only at an energy controller for supplying power to said radiant heating device.

18. The method as claimed in claim 1, wherein detection of a switching state takes place at an energy controller for supplying power to said radiant heating device and additionally takes place at said safety temperature limiter.

19. The method as claimed in claim 1, wherein a switching state of said safety temperature limiter is detected by at least one of the following possibilities:

measuring a voltage across said radiant heating device, measuring a current flowing through said radiant heating device, measuring a current flowing parallel to a series circuit in said hob, said series circuit comprising said safety temperature limiter and said radiant heating device.

20. The method as claimed in claim 1, wherein said time at which said safety temperature limiter activates and deactivates said radiant heating device is monitored throughout a cooking process with said cooking vessel on said hob plate above said radiant heating device by, after a time of more than 5 min and/or after more than ten deactivations of said radiant heating device by said safety temperature limiter, shortening a duration of activation of said radiant heating device being evaluated as said cooking vessel having boiled-dry and then said power with which said radiant heating device is activated and is operated being reduced or said radiant heating device being deactivated.

21. A hob for carrying out said method as claimed in claim 1, wherein said hob has:

wherein said radiant heating device comprises said safety temperature limiter in its upper region or between a heating conductor of said radiant heating device and said hob plate.

22. The hob as claimed in claim 21, having an electronic control device, wherein said control device activates or deactivates said radiant heating device via switching elements.

23. The hob as claimed in claim 22, having an electronic control device activating or deactivating said radiant heating device via switching elements by way of connection to a mains voltage or complete disconnection from said mains voltage.

24. The hob as claimed in claim 21, wherein said power for said radiant heating device is set by means of an electromechanical control device, where said hob has an additional controller for detecting a switching state of said safety temperature limiter.

25. The hob as claimed in claim 21, wherein only one single additional controller is provided for all cooking points or all said radiant heating devices of said hob.

26. The hob as claimed in claim 21, wherein it has a mains power supply with a connection to a neutral conductor, wherein either a single common disconnector relay is provided in said connection to a neutral conductor for all said radiant heating devices, or where a dedicated disconnector relay is provided in a connection to a neutral conductor for each said radiant heating devices.

* * * * *